US006638902B2

(12) United States Patent
Tarara et al.

(10) Patent No.: US 6,638,902 B2
(45) Date of Patent: Oct. 28, 2003

(54) STABLE SOLID ENZYME COMPOSITIONS AND METHODS EMPLOYING THEM

(75) Inventors: James J. Tarara, Woodbury, MN (US); Sally K. Swart, Inver Grove Heights, MN (US); Tareasa Lynn Bradley, Inver Grove Heights, MN (US); Reid Rabon, South St. Paul, MN (US); Denise Chandler, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/773,965

(22) Filed: Feb. 1, 2001

(65) Prior Publication Data

US 2002/0177541 A1 Nov. 28, 2002

(51) Int. Cl.[7] ..... C11D 7/42; C11D 3/386

(52) U.S. Cl. ..... 510/392; 510/108; 510/111; 510/113; 510/161; 510/224; 134/1; 134/2; 134/22.14; 134/22.16; 134/22.17; 134/22.19; 134/25.1; 134/25.9; 134/35.42

(58) Field of Search ..... 510/161, 392, 510/224; 134/1, 2, 22.14, 22.16, 22.17, 22.19, 25.1, 25.4, 35.42

(56) References Cited

U.S. PATENT DOCUMENTS

| | | | | |
|---|---|---|---|---|
| 1,580,576 | A | | 4/1926 | Weidner |
| 1,949,264 | A | | 2/1934 | Bagley |
| 2,412,819 | A | | 12/1946 | MacMahon |
| 2,920,417 | A | | 1/1960 | Wertheimer |
| 2,927,900 | A | | 3/1960 | Shiraeff |
| 2,987,483 | A | | 6/1961 | Brooker |
| 3,048,548 | A | | 8/1962 | Martin et al. |
| 3,306,858 | A | | 2/1967 | Oberle |
| 3,334,147 | A | | 8/1967 | Brunelle et al. |
| 3,351,558 | A | | 11/1967 | Zimmerer |
| 3,382,178 | A | | 5/1968 | Lissant et al. |
| 3,390,092 | A | | 6/1968 | Keast et al. |
| 3,390,093 | A | | 6/1968 | Feierstein et al. |
| 3,392,121 | A | | 7/1968 | Gedge, III |
| 3,441,511 | A | | 4/1969 | Otrhalek et al. |
| 3,442,242 | A | | 5/1969 | Laskey et al. |
| 3,491,028 | A | | 1/1970 | Crotty et al. |
| 3,557,003 | A | | 1/1971 | Morris et al. |
| 3,639,286 | A | | 2/1972 | Ballestra et al. |
| 3,695,989 | A | | 10/1972 | Albert |
| 3,790,482 | A | | 2/1974 | Jones et al. |
| 3,816,320 | A | | 6/1974 | Corliss |
| 3,846,346 | A | | 11/1974 | Conn |
| 3,856,932 | A | | 12/1974 | May |
| 3,887,614 | A | | 6/1975 | Susuki et al. |
| 3,899,436 | A | | 8/1975 | Copeland et al. |
| 3,933,670 | A | | 1/1976 | Brill et al. |
| 3,936,386 | A | | 2/1976 | Corliss et al. |
| 3,941,710 | A | | 3/1976 | Gilbert et al. |
| 3,961,754 | A | | 6/1976 | Kuhns et al. |
| 3,985,669 | A | | 10/1976 | Krummel et al. |
| 4,000,080 | A | | 12/1976 | Bartolotia et al. |
| 4,072,621 | A | | 2/1978 | Rose |
| 4,083,795 | A | | 4/1978 | Joubert |
| 4,105,573 | A | | 8/1978 | Jacobsen |
| 4,147,650 | A | | 4/1979 | Sabatelli et al. |
| 4,148,603 | A | | 4/1979 | Schwuger et al. |
| 4,211,517 | A | | 7/1980 | Schmid |
| 4,212,761 | A | * | 7/1980 | Ciaccio ..... 252/174.12 |
| 4,216,125 | A | | 8/1980 | Campbell et al. |
| 4,219,436 | A | | 8/1980 | Gromer et al. |
| 4,238,345 | A | | 12/1980 | Guilbert |
| 4,243,543 | A | | 1/1981 | Guilbert et al. |
| 4,261,868 | A | | 4/1981 | Hora et al. |
| 4,268,406 | A | | 5/1981 | O'Brien et al. |
| 4,274,975 | A | | 6/1981 | Corkill et al. |
| 4,276,205 | A | | 6/1981 | Ferry |
| 4,284,532 | A | | 8/1981 | Leikhim et al. |
| 4,289,815 | A | | 9/1981 | Lee |
| 4,329,246 | A | | 5/1982 | Gilbert et al. |
| 4,348,293 | A | | 9/1982 | Clarke et al. |
| 4,359,413 | A | | 11/1982 | Ward et al. |
| 4,416,793 | A | | 11/1983 | Barrat et al. |
| 4,426,362 | A | | 1/1984 | Copeland et al. |
| 4,474,976 | A | | 10/1984 | Faltynek |
| 4,481,167 | A | | 11/1984 | Ginter et al. |
| 4,537,706 | A | | 8/1985 | Severson, Jr. |
| 4,587,031 | A | | 5/1986 | Kruse et al. |
| 4,594,175 | A | | 6/1986 | Copeland |
| 4,595,520 | A | | 6/1986 | Heile et al. |
| 4,605,509 | A | | 8/1986 | Corkill et al. |
| 4,608,187 | A | | 8/1986 | Chang |
| 4,608,189 | A | | 8/1986 | Koch et al. |
| 4,618,914 | A | | 10/1986 | Sato et al. |

(List continued on next page.)

FOREIGN PATENT DOCUMENTS

| | | |
|---|---|---|
| AU | 687075 | 2/1953 |
| DE | 297 183 A5 | 1/1992 |

(List continued on next page.)

OTHER PUBLICATIONS

Translation of German Published, Non–Examined Patent Application DE OS 28 10 999, filed under No. 28 10 999.1 on Mar. 14, 1978, and published on Sep. 21, 1978, claiming the priority of British Patent Application 1147–077; Title: Dishwasher Detergent; Applicant: Unilever N.V.; Representative: Dr. F. Lederer; Inventor: Wolfgang Prox.

"Hawley's Condensed Chemical Dictionary", Twelfth Edition, Revised by Richard J. Lewis, Sr., p. 176 (1993).

*Primary Examiner*—Yogendra N. Gupta
*Assistant Examiner*—Eisa Elhilo
(74) *Attorney, Agent, or Firm*—Merchant & Gould P.C.

(57) ABSTRACT

The present invention relates to a solid enzyme cleaning composition in which the enzyme is stable in the presence of mixtures of carbonate and bicarbonate at alkaline pH, and methods employing this composition. The enzyme cleaning composition preferably employs weight ratios of carbonate and bicarbonate to stabilize one or more enzymes in a solid, a concentrate, and/or a use composition, and at temperatures higher than ambient.

31 Claims, No Drawings

U.S. PATENT DOCUMENTS

| | | | |
|---|---|---|---|
| 4,664,848 | A | 5/1987 | Oh et al. |
| 4,677,130 | A | 6/1987 | Puzig |
| 4,680,134 | A | 7/1987 | Heile et al. |
| 4,687,121 | A | 8/1987 | Copeland |
| 4,690,305 | A | 9/1987 | Copeland |
| 4,692,494 | A | 9/1987 | Sonenstein |
| 4,695,284 | A | 9/1987 | Hight |
| 4,698,181 | A | 10/1987 | Lewis |
| 4,715,979 | A | 12/1987 | Moore et al. |
| 4,725,376 | A | 2/1988 | Copeland |
| 4,753,755 | A | 6/1988 | Gansser |
| RE32,762 | E | 10/1988 | Katzmann et al. |
| RE32,763 | E | 10/1988 | Fernholtz et al. |
| RE32,818 | E | 1/1989 | Fernholz et al. |
| 4,826,661 | A | 5/1989 | Copeland et al. |
| 4,830,773 | A | 5/1989 | Olson |
| 4,836,951 | A | 6/1989 | Totten et al. |
| 4,845,965 | A | 7/1989 | Copeland et al. |
| 4,846,993 | A | 7/1989 | Lentsch et al. |
| 4,858,449 | A | 8/1989 | Lehn |
| 4,895,667 | A | 1/1990 | Fox et al. |
| 4,965,012 | A | 10/1990 | Olson |
| 4,983,315 | A | 1/1991 | Glogowski et al. |
| 5,019,292 | A | 5/1991 | Baeck et al. |
| 5,034,147 | A | 7/1991 | Ramachandran |
| 5,061,392 | A | 10/1991 | Bruegge et al. |
| 5,064,561 | A | 11/1991 | Rouillard |
| 5,078,301 | A | 1/1992 | Gladfelter et al. |
| 5,080,819 | A | 1/1992 | Morganson et al. |
| 5,118,426 | A | 6/1992 | Duncan et al. |
| 5,122,538 | A | 6/1992 | Lokkesmoe et al. |
| 5,173,207 | A | 12/1992 | Drapier et al. |
| 5,223,179 | A | 6/1993 | Connor et al. |
| 5,234,719 | A | 8/1993 | Richter et al. |
| 5,254,287 | A | 10/1993 | Deleeuw et al. |
| 5,290,496 | A | 3/1994 | Carduck et al. |
| 5,292,525 | A | 3/1994 | Brenden et al. |
| 5,312,561 | A | 5/1994 | Hoshino et al. |
| 5,316,688 | A | 5/1994 | Gladfelter et al. |
| 5,358,653 | A | 10/1994 | Gladfelter et al. |
| 5,382,377 | A | 1/1995 | Raehse et al. |
| 5,407,700 | A | 4/1995 | Man et al. |
| 5,419,850 | A | 5/1995 | Backes et al. |
| 5,429,766 | A | 7/1995 | Sone et al. |
| 5,451,336 | A | 9/1995 | Schwadtke et al. |
| 5,474,698 | A | 12/1995 | Rolando et al. |
| 5,494,817 | A | 2/1996 | Chen |
| 5,516,449 | A | 5/1996 | Agar et al. |
| 5,559,089 | A | 9/1996 | Hartman et al. |
| 5,578,134 | A | 11/1996 | Lentsch et al. |
| 5,589,099 | A | 12/1996 | Baum |
| 5,650,017 | A | 7/1997 | Gordon et al. |
| 5,665,694 | A | 9/1997 | Backes et al. |
| 5,691,292 | A | 11/1997 | Marshall et al. |
| 5,763,378 | A | 6/1998 | Painter et al. |
| 5,858,117 | A | 1/1999 | Oakes et al. |
| 5,858,299 | A | 1/1999 | Fernholz et al. |
| 5,861,366 | A | 1/1999 | Ihns et al. |
| 5,876,514 | A | 3/1999 | Rolando et al. |
| 5,990,068 | A | 11/1999 | Brouwer et al. |
| 6,008,174 | A | 12/1999 | Brouwer et al. |
| 6,017,864 | A | 1/2000 | Brittain et al. |
| 6,060,444 | A | 5/2000 | Schulz et al. |
| 6,136,769 | A | 10/2000 | Asano et al. |
| 6,156,715 | A * | 12/2000 | Lentsch et al. ..... 510/224 |

FOREIGN PATENT DOCUMENTS

| | | |
|---|---|---|
| EP | 0 161 596 A2 | 5/1985 |
| EP | 0 363 852 A1 | 4/1990 |
| EP | 0 364 840 A1 | 4/1990 |
| EP | 0 501 375 A1 | 9/1992 |
| EP | 0 561 452 A1 | 3/1993 |
| EP | 0 364 840 B2 | 3/1996 |
| GB | 2 003 913 A | 3/1979 |
| GB | 2 005 715 A | 4/1979 |
| GB | 1 596 756 | 8/1981 |
| GB | 2 271 120 A | 4/1994 |
| JP | 6-187800 | 5/1986 |
| JP | 9-217100 | 8/1997 |
| WO | WO 92/02611 | 2/1992 |
| WO | WO 92/13061 | 8/1992 |
| WO | WO 93/21299 | 10/1993 |
| WO | WO 95/18215 | 7/1995 |
| WO | WO 96/06910 | 3/1996 |
| WO | WO 96/08555 | 3/1996 |
| WO | WO 96/41859 | 12/1996 |
| WO | WO 97/02753 | 1/1997 |
| WO | WO 97/05226 | 2/1997 |
| WO | WO 97/07190 | 2/1997 |
| WO | WO 97/12025 | 4/1997 |
| WO | WO 97/43388 | 11/1997 |
| WO | WO 98/30674 | 7/1998 |
| WO | WO 98/54285 | 12/1998 |

* cited by examiner

STABLE SOLID ENZYME COMPOSITIONS AND METHODS EMPLOYING THEM

FIELD OF THE INVENTION

The present invention relates to a solid enzyme cleaning composition in which the enzyme is stable in the presence of mixtures of carbonate and bicarbonate at alkaline pH, and methods employing this composition. The enzyme cleaning composition preferably employs weight ratios of carbonate and bicarbonate to stabilize one or more enzymes in a solid, a concentrate, and/or a use composition, and at temperatures higher than ambient.

BACKGROUND OF THE INVENTION

A major challenge of detergent development for the health care industry, restaurants, and homes is the successful removal of soils that are resistant to conventional treatment and the elimination of chemicals that are not compatible with the surroundings. One such soil is protein, and one such chemical is chlorine or chlorine yielding compounds, which can be incorporated into detergent compounds or added separately to cleaning programs for protein removal. Protein soil residues, often called protein films, occur in health care, in use and maintenance of medical instruments and devices, in food processing, in restaurants, in laundries, and in home cleaning situations.

In the past, chlorine has been employed to degrade protein by oxidative cleavage and hydrolysis of the peptide bond, which breaks apart large protein molecules into smaller peptide chains. The conformational structure of the protein disintegrates, dramatically lowering the binding energies, and effecting desorption from the surface, followed by solubilization or suspension into the cleaning solution. The use of chlorinated detergent is not without problems, such as harshness and corrosion. In addition, a new issue may force change upon both the industry, consumers, and detergent manufacturers: the growing public concern over the health and environmental impacts of chlorine and organochlorines.

Detersive enzymes represent an alternative to chlorine and organochlorines. Enzymes have been employed in cleaning compositions since early in the $20^{th}$ century. However, it took years of research, until the mid 1960's, before enzymes like bacterial alkaline proteases were commercially available and which had all of the pH stability and soil reactivity for detergent applications. Patents issued through the 1960s related to use of enzymes for consumer laundry pre-soak or wash cycle detergent compositions and consumer automatic dishwashing detergents. Early enzyme cleaning products evolved from simple powders containing alkaline protease to more complex granular compositions containing multiple enzymes to liquid compositions containing enzymes.

Solid cleaning compositions containing enzymes have advantages compared to liquid forms. In liquid compositions, various factors can cause enzyme degradation. For example, enzymes often denature or degrade in an aqueous medium resulting in the serious reduction or complete loss of enzyme activity. For these reasons and for expanded applications, it became desirable to have solid enzyme compositions.

The use of solid block detergents in institutional and industrial cleaning operations was pioneered using highly alkaline material, based on a substantial proportion of sodium hydroxide. Initial solid block products (and predecessor powder products) used a substantial proportion of a solidifying agent, sodium hydroxide hydrate, to solidify the cast material in a freezing process using the low melting point of sodium hydroxide monohydrate (about 50° C.–65° C.). The active components of the detergent were mixed with the molten sodium hydroxide and cooled to solidify. The resulting solid was a matrix of hydrated solid sodium hydroxide with the detergent ingredients dissolved or suspended in the hydrated matrix. Heating an enzyme in molten sodium hydroxide would most often inactivate the enzyme.

In these early products sodium hydroxide was an ideal candidate because of the highly alkaline nature of the caustic material provided excellent cleaning. In recent years, attention has been directed to producing a highly effective detergent material from less caustic materials such as soda ash, also known as sodium carbonate, because of manufacturing, processing, etc. advantages. Sodium carbonate is a milder base, thus it is substantially less strong (has a smaller $K_b$) than sodium hydroxide. This disadvantage has been addressed. Initially, solid detergents were made of substantially hydrated carbonate, which contained at least about seven moles of water of hydration per mole of sodium carbonate and were not dimensionally stable. This disadvantage has also been addressed. One disadvantage has not been addressed, stably including an enzyme in a carbonate based solid cleaner.

A marketable solid enzyme composition must include an enzyme that is stabilized so that it will retain its functional activity for prolonged periods of (shelf-life or storage) time. The enzyme must also remain stable for a sufficient time in use to provide adequate cleaning. If a stabilized enzyme system is not employed, an excess of enzyme is generally required to compensate for expected loss. However, enzymes are expensive and are in fact the most costly ingredients in a commercial cleaning composition, even though they are present in relatively minor amounts. There remains a need for methods and compositions for stabilizing enzymes in cleaning compositions, particularly in carbonate-based solids at alkaline pH.

SUMMARY OF THE INVENTION

The present invention relates to a solid enzyme cleaning composition in which the enzyme is stable in the presence of mixtures of carbonate and bicarbonate at alkaline pH, and methods employing this composition. The enzyme cleaning composition preferably employs weight ratios of carbonate and bicarbonate to stabilize one or more enzymes in a solid, a concentrate, and/or a use composition, and at temperatures higher than ambient. The present composition maintains stability of the enzyme at alkaline pH, which preferably falls in the range of about 8 to about 11.5. The present composition preferably includes a mixture of carbonate and bicarbonate in which the weight ratio of carbonate to bicarbonate is in the range of about 0.5:1 to about 4.75:1.

In an embodiment, the solid enzyme cleaning composition includes a detersive enzyme; a mixture of carbonate and bicarbonate; and one or more of a binder including a defined carbonate hydrate, a surfactant, a builder, a chelating agent, or a combination thereof. These ingredients are preferably formulated so that the detersive enzyme retains at least about 50% of its initial activity at 120° F. for at least about 30 minutes after forming a use composition. In an embodiment, the solid enzyme cleaning composition includes a surfactant, a detersive enzyme, a mixture of carbonate and bicarbonate, a binder including a defined carbonate hydrate, a builder, and a chelating agent. The composition can also include one or more dyes or fragrances.

The present composition can stabilize one or more of a variety of enzymes, particularly any of a variety of detersive enzymes. Detersive enzymes that can be employed in the present compositions include a protease, an amylase, a lipase, a cellulase, a peroxidase, a gluconase, or a mixture thereof. Preferably the detersive enzyme is a protease, an amylase, a lipase, a cellulase, or a mixture thereof. Preferred proteases include an alkaline protease, such as an alkaline protease derived from *Bacillus alcalophilus*. Preferred amylases include an endoamylase. Preferred lipases include a lipolase.

DETAILED DESCRIPTION OF THE INVENTION

Definitions

As used herein, bicarbonate, carbonate, carbonic acid salt, and the like are used to refer to a salt such as sodium carbonate, sodium bicarbonate, potassium carbonate, potassium bicarbonate or another salt obtained by or that can be visualized as being obtained by full or partial neutralization of carbonic acid. The weight percent of a salt of carbonate or bicarbonate can be expressed either as the weight percent of just the anionic carbonate or bicarbonate, or of the entire salt including the cation.

As used herein, the phrases "mixture of bicarbonate and carbonate" or "mixture of carbonate and bicarbonate" refers to a mixture of carbonate and bicarbonate salts. These mixtures are typically produced by separately weighing and adding to the composition of the invention a carbonate and a bicarbonate. The weight-% of either carbonate or bicarbonate in a composition of the invention is based on the amounts that have been weighed and added. The mixture can also include other acids and bases which can affect the final amounts of carbonate and bicarbonate actually found in the in the final solid composition or in a solution made from this final composition.

As used herein, a solid cleaning composition refers to a cleaning composition in the form of a solid such as a powder, a flake, a granule, a pellet, a tablet, a lozenge, a puck, a briquette, a brick, a solid block, a unit dose, or another solid form known to those of skill in the art.

As used herein, the term "cleaner" refers to a component added to a cleaning composition to provide cleaning power. Cleaners include surfactants, sources of alkalinity (e.g. alkali metal carbonates), chelators, antiredeposition agents, and the like, or combinations thereof.

As used herein, weight percent, percent by weight, % by weight, and the like are synonyms that refer to the concentration of a substance as the weight of that substance divided by the weight of the composition and multiplied by 100.

As used herein, the term "instrument" refers to the various medical or dental instruments or devices that can benefit from cleaning with an enzyme presoak or enzyme cleaning composition.

As used herein, the phrases "medical instrument", "dental instrument", "medical device", "dental device", "medical equipment", or "dental equipment" refer to instruments, devices, tools, appliances, apparatus, and equipment used in medicine or dentistry. Such instruments, devices, and equipment can be cold sterilized, soaked or washed and then heat sterilized, or otherwise benefit from cleaning in a composition of the present invention. These various instruments, devices and equipment include, but are not limited to: diagnostic instruments, trays, pans, holders, racks, forceps, scissors, shears, saws (e.g. bone saws and their blades), hemostats, knives, chisels, rongeurs, files, nippers, drills, drill bits, rasps, burrs, spreaders, breakers, elevators, clamps, needle holders, carriers, clips, hooks, gouges, curettes, retractors, straightener, punches, extractors, scoops, keratomes, spatulas, expressors, trocars, dilators, cages, glassware, tubing, catheters, cannulas, plugs, stents, arthoscopes and related equipment, and the like, or combinations thereof.

As used herein, basic or alkaline pH refers to pH greater than 7, preferably greater than 8 and up to about 14. Preferably basic or alkaline pH is in the range of about 8 to about 11.5. A preferred alkaline or basic pH value is in the range of about 10 to about 11.

As used herein, ambient temperature refers to the temperature of the surroundings of the solid enzyme cleaning composition under normal conditions for storage or transportation. Although the product may be stored and transported at temperatures in the range of about 0° F. to about 100° F., ambient temperature preferably refers to room temperature of about 72° F. or 25° C. Elevated temperatures refer to temperatures above room temperature and commonly employed for washing or presoaking wares or instruments, such as temperatures of about 110° F. to about 120° F.

As used herein, the term "about" modifying the quantity of an ingredient in the compositions of the invention or employed in the methods of the invention refers at least to variation in the numerical quantity that can occur, for example, through typical measuring and liquid handling procedures used for making solids or use solutions in the real world; through inadvertent error in these procedures; through differences in the manufacture, source, or purity of the ingredients employed to make the compositions or carry out the methods; and the like. Whether or not modified by the term "about", the claims include equivalents to the quantities.

A Stabilized Enzyme Cleaning Composition

The present invention relates to a solid enzyme cleaning composition that employs a mixture of carbonate and bicarbonate to provide improved enzyme stability and/or activity at basic pH. In particular, the present cleaning composition containing a mixture of carbonate and bicarbonate provides increased stability and/or activity for detersive enzymes such as proteases, amylases, other enzymes employed with proteases, and detersive enzymes employed in the absence of proteases. Preferably, the mixture of carbonate and bicarbonate includes a ratio of carbonate to bicarbonate of less than about 4.75:1, for example, about 0.5:1 to about 3.5:1, preferably about 1:1 to about 3:1, preferably about 1:1, about 2.1:1, or about 2.7:1, more preferably about 2:1 or about 3:1, more preferably about 2.1:1 or about 2.7:1. Such ratios can improve enzyme stability at basic pH by maintaining stability of the enzyme and/or to enhancing enzyme activity at higher levels of pH compared to compositions lacking these ratios of carbonate to bicarbonate.

In the present compositions, carbonate provides a source of alkalinity both for cleaning power and for buffering a solution of the enzyme composition. Suitable sources of carbonate include soda ash, other sources of sodium carbonate, and other carbonate salts such as other alkali metal carbonate salts, and the like, or combinations thereof. Preferred sources of carbonate include soda ash and the like. The stabilized enzyme composition typically contains about 3 to about 73% by weight carbonate, preferably about 20 to about 70% by weight, preferably about 30 to about 50% by weight, preferably about 30% by weight (including about 28 to about 33% by weight), preferably about 35 to about 45% by weight, preferably about 40% by weight (including about 38 to about 42% by weight).

In the present compositions, bicarbonate provides a source of alkalinity for cleaning power and, compared to carbonate, an acid component of a buffer for a solution of the enzyme composition. Suitable sources of bicarbonate include sodium bicarbonate, and other bicarbonate salts such as other alkali metal bicarbonate salts, and the like, or combinations thereof. Preferred sources of bicarbonate include sodium bicarbonate. The stabilized enzyme composition typically contains about 1 to about 30% by weight bicarbonate, preferably about 29% by weight, preferably about 1 to about 27% by weight carbonate, preferably about to about 25% by weight, preferably about 10 to about 20% by weight, preferably about 12 to about 18% by weight, preferably about 15% by weight, preferably about 15 to about 25% by weight, preferably about 20% by weight, preferably about 19% by weight.

Preferred mixtures of carbonate and bicarbonate provide desirable increases in enzyme stability at basic pH compared to other buffer systems suitable for maintaining a pH above about 8, preferably above about 10, preferably in the range of about 8 to about 11.5, about 10 to about 11, more preferably about 10.3 to about 10.8. Maintaining an alkaline pH provides greater cleaning power for an alkaline cleaning composition, for most surfactants present in the cleaning composition, and for the detersive enzyme, particularly when the enzyme is an alkaline protease.

Ratios of carbonate to bicarbonate within a certain range enhance stability or activity of an enzyme in the present composition. A ratio of carbonate to bicarbonate of below about 1:1 (wt:wt) or above about 4.75:1 in certain test enzyme compositions did not provide effective stabilization of the enzyme. A ratio of carbonate to bicarbonate of about 1:1 (wt:wt) to about 4.75:1 in an enzyme composition can provide effective stabilization of the enzyme. The ratio of carbonate to bicarbonate is preferably about 1:1 to about 3:1, preferably about 1:1, preferably about 2:1 to about 3:1, preferably about 2.1:1 to about 2.7:1, more preferably about 2:1 or about 3:1, more preferably about 2.1:1 or about 2.7:1. The ratio of carbonate to bicarbonate can be as low as about 0.1:1, about 0.2:1, about 0.3:1, about 0.4:1, about 0.5:1, about 0.6:1, about 0.7:1, about 0.8:1, about 0.9:1, or about 1:1, preferably at or above about 0.5:1. The ratio of carbonate to bicarbonate can be as high as about 3:1, about 3.2:1, about 3.4:1, about 3.6:1, about 3.8:1, about 4:1, about 4.2: 1, about 4.4:1, or about 4.6:1, preferably at or below about 3:1.

Improving enzyme stability and/or activity at basic pH can include, for example, maintaining stability of the enzyme and/or to enhancing enzyme activity at higher levels of pH, when compared to compositions lacking these ratios of carbonate to bicarbonate. Maintaining stability occurs when an enzyme retains activity for a longer period of time under a particular set of conditions. The conditions preferably include a temperature above ambient temperature, such as about 120° F. Preferably, maintaining stability includes retaining all, nearly all, or an effective detersive amount of the protease activity for at least about 1.5-fold, 2-fold, 4-fold, or more longer than the same enzyme in a control composition lacking these ratios of carbonate to bicarbonate. Enhancing enzyme activity at higher levels of pH can include shifting the pH-rate profile of the enzyme to higher pH, extending or broadening a peak or plateau level of activity to a higher pH, or decreasing the slope of an arm of the pH-rate profile that descends with increasing pH. For example, the enzyme can exhibit a pH rate profile shifted 0.25, 0.5, 1, or more pH units toward higher pH; the peak or plateau can extend an additional 0.25, 0.5, 1, or more pH units toward higher pH; and/or the slope of a descending arm of the pH rate profile can be decreased so that the enzyme exhibits useful detersive activity at an additional 0.25, 0.5, 1, or more pH units toward higher pH.

The present enzyme cleaning composition can also provide stability of the enzyme in the presence of materials that reduce the availability of metal ions (e.g. calcium or magnesium ions). Some conventional enzyme cleaning compositions include divalent ions, such as calcium, for stabilizing the enzyme. Such conventional compositions must either lack any material that reduces the availability of the metal ion, or include metal ion in excess of such a material. The present enzyme cleaning compositions, surprisingly, provide a stable enzyme in the presence of materials, such as chelators, sequestrants, and builders, that reduce the availability of metal ions. Preferably, the present enzyme cleaning compositions do not include added metal ions, such as added calcium chloride.

Improving enzyme stability and/or activity at basic pH can include, for example, maintaining stability of the enzyme and/or enhancing enzyme activity at higher levels of pH, when compared to compositions lacking or with reduced amounts of chelator, sequestrant, or builder. Improving enzyme stability and/or activity at basic pH can include, for example, maintaining stability of the enzyme and/or enhancing enzyme activity at higher levels of pH, when compared to compositions including metal ion enzyme stabilizing agents, such as calcium or magnesium ions. Maintaining stability occurs when an enzyme retains activity for a longer period of time under a particular set of conditions. The conditions preferably include a temperature above ambient temperature, such as about 120° F. Preferably, maintaining stability includes retaining all, nearly all, or an effective detersive amount of the protease activity for at least about 1.5-fold, 2-fold, 4-fold, or more longer than the same enzyme in a control composition lacking chelator, sequestrant, or builder; or a control composition including metal ion enzyme stabilizing agents, such as calcium or magnesium ions.

The composition of the present invention can also enhance the activity of an enzyme. That is, the enzyme exhibits greater activity after formulation in a composition of the invention than does control enzyme formulated in a control composition or direct from the supplier.

The carbonate salt, e.g. sodium carbonate, can provide significantly greater enzyme stability at ambient temperature and at one or more temperatures above ambient, or under other conditions indicative of storage and use stability. For example, preferably, in the present composition, the detersive enzyme retains at least about 80 to about 95%, preferably at least about 95%, of its initial activity at ambient temperature for at least about 1 year after forming the composition. Preferably, in the present composition, the detersive enzyme retains at least about 80 to about 95%, preferably at least about 95%, of its initial activity at 100° F. for at least about 8 weeks after forming the composition.

Enzyme stability and activity are typically measured by methods known to those of skill in the art. For example, the activity of the enzyme can be measured with a known enzyme assay at the time the composition is formulated and then again after the composition has been exposed to desired conditions of temperature, humidity, or the like for a predetermined time. Comparing the activity obtained after exposure to the activity at an earlier time or at formulation provides a measure of enzyme stability. Suitable assays for a detersive protease include assays known to those of skill in the art, such as those employing an azocasein substrate. Suitable assays for a detersive amylase include the Phadebas® assay for determining α-amylase activity, which is known to those of skill in the art. Enzyme assays typically include some error in the determination of enzyme activity, and that error can typically be as much as about 20%, or sometimes more. Thus, an enzyme that retains full activity (or 100% of its initial activity) may show as little as about 80% of that activity in an enzyme assay. Known protocols including replicate assays and statistical analysis can be employed for determining whether the activity present is equal to (within experimental error) the initial activity, or a particular fraction of that initial activity.

The present enzyme cleaning compositions typically include ingredients in addition to the enzyme, carbonate, and bicarbonate. Preferred additional ingredients include one or more surfactants, such as a nonionic surfactant; one or more chelators or sequestrants, such as a phosphonate (e.g. amino tri(methylene phosphonic Acid) (ATMP)); one or more builders or sources of alkalinity, such as a phosphate (e.g. tripolyphosphate). Preferably, a nonionic surfactant, such as nonyl phenol ethoxylate 9.5, is present at about 2 to about 32 wt-%, preferably about 4 to about 20 wt-%, preferably about 5 to about 10 wt-%, preferably about 8 wt-%. Preferably, a phosphate, such as tripolyphosphate, is present at about 4 to about 80 wt-%, preferably about 8 to about 40 wt-%, preferably about 15 to about 20 wt-%, preferably about 17–18 wt-%. Preferably, a chelator or sequestrant, such as a phosphonate (e.g. ATMP), is present at about 1 to about 16 wt-%, preferably about 2 to about 8 wt-%, preferably about 3 to about 6 wt-%, preferably about 4–5 wt-%. Preferably, an enzyme, such as a protease, is present at about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%.

In one preferred embodiment, the present enzyme cleaning composition includes about 8 wt-% nonyl phenol ethoxylate 9.5, about 18 wt-% tripolyphosphate, about 4 wt-% protease, and about 5 wt-% ATMP. In another preferred embodiment, the present enzyme cleaning composition includes about 8 wt-% nonyl phenol ethoxylate 9.5, about 18 wt-% tripolyphosphate, about 6 wt-% protease, and about 5 wt-% ATMP. In yet another preferred embodiment, the present enzyme cleaning composition includes about 8 wt-% nonyl phenol ethoxylate 9.5, about 17 wt-% tripolyphosphate, about 8 wt-% protease, and about 5 wt-% ATMP. In even another preferred embodiment, the present enzyme cleaning composition includes about 7.5 wt-% nonyl phenol ethoxylate 9.5, about 20 wt-% tripolyphosphate, about 1 wt-% protease, and about 7 wt-% ATMP.

The stabilized enzyme cleaning composition of the present invention can be employed with a variety of different surfactants, enzymes, and additional ingredients to form a variety of cleaning, destaining, and sanitizing products useful for cleaning a wide variety of articles that can be cleaned or presoaked. Preferably, the composition of the invention is formulated for cleaning or presoaking medical, dental, or surgical instruments, devices, or equipment, components of such items, and the like. The composition of the invention can be employed for cleaning, destaining, or sanitizing products for presoaks, utensils, dish or cooking ware, machine ware washing, laundry and textile cleaning and destaining, carpet cleaning and destaining, cleaning-in-place (CIP) cleaning and destaining, drain cleaning, presoaks for medical and/or dental instrument cleaning, and washing or presoaks for meat cutting the equipment and other food processing surfaces.

The solid enzyme cleaning compositions of the present invention can include a source of alkalinity preferably an alkali metal carbonate, an alkali metal salt of a sequestrant, preferably a potassium salt of an organophosphonate and, preferably, an E-form hydrate binding agent. Aspects of the present solid compositions, binding agents, and methods of making these compositions are described in U.S. patent application Ser. Nos. 08/989,824 filed Dec. 12, 1997, and entitled BINDING AGENT FOR SOLID BLOCK FUNCTIONAL MATERIAL; and 09/089,095, filed Jun. 2, 1998, and entitled STABLE SOLID BLOCK METAL PROTECTING WAREWASHING DETERGENT COMPOSITION; the disclosures of which are incorporated herein by reference.

Carbonate and Bicarbonate Based Solid Matrix

The present enzyme cleaning compositions are typically solids based on a matrix of carbonate and bicarbonate, but including additional ingredients. The solid matrix includes conventional alkaline carbonate cleaning agent, a sequestering agent, and other active ingredients that will vary according to the type of composition being manufactured. Preferred ingredients are as follows:

Solid Matrix Composition

| Chemical | Percent Range |
|---|---|
| Alkali metal salt of an Organophosphonate | 1–30 wt %; preferably 3–15 wt % of a potassium salt thereof |
| Water | 5–15 wt %; preferably 5–12 wt % |
| Alkali Metal Carbonate | 25–80 wt %; preferably 30–55 wt % |
| Surfactant | 0 to 25 wt %; preferably 0.1–20 wt % |

Solidification of this material typically produces an E-form hydrate binder composition. This hydrate binder is not a simple hydrate of the carbonate component, as is described briefly below and in greater detail in U.S. patent application Ser. Nos. 08/989,824 and 09/089,095, which have been incorporated herein by reference.

Alkaline Source

The enzyme cleaning composition produced according to the invention can include effective amounts of one or more alkaline sources to enhance cleaning of a substrate and improve soil removal performance of the composition. The alkaline matrix can be bound into a solid due to the presence of the binder hydrate composition including its water of hydration. Such a composition includes about 10–80 wt %, preferably about 15–70 wt % of an alkali metal carbonate source, most preferably about 20–60 wt %. A metal carbonate such as sodium or potassium carbonate, bicarbonate, sesquicarbonate, mixtures thereof and the like can be used. The total alkalinity source can include about 5 wt % or less of an alkali metal hydroxide. The alkali metal hydroxide is preferably present in an amount that does not disadvantageously alter the balance of carbonate to bicarbonate but that can, for example, balance other added acidic materials. Preferably carbonate and bicarbonate are the primary sources of alkalinity, with any other source present only to neutralize other acidic materials.

A highly effective detergent material can be made with little water (i.e. less than 11.5 wt %, preferably less than 10 wt % water) based on the total amount of solid. The carbonate based materials can be made in extrusion methods with little water. The total amount of water present in the solid block detergents of the invention is preferably less than about 11 to 12 wt-% water based on the total chemical composition (not including the weight of the container, if any). The preferred solid detergent includes less than about 2.0, more preferably about 0.9 to 1.7 moles of water per each mole of carbonate. Preferred stable solid detergents will include about 5 to 20 wt %, preferably 10 to 15 wt % anhydrous carbonate. The balance of the carbonate includes carbonate monohydrate. Further, some small amount of sodium carbonate monohydrate can be used in the manufacture of the detergent, however, such water of hydration is used in this calculation.

The alkali metal carbonate can be used in a formulation that includes an effective amount of a hardness sequestering agent that both sequesters hardness ions such as calcium, magnesium and manganese but also provides soil removal and suspension properties. The formulations can also contain a surfactant system that, in combination with the sodium carbonate and other components, effectively removes soils at typical use temperatures and concentrations. The solid detergent can also contain other common additives such as surfactants, builders, thickeners, soil anti-redeposition agents, defoamers, rinse aids, dyes, perfumes, etc.

Binder Composition

A preferred binding agent includes a solid matrix based on a combination of a carbonate hydrate and a non-hydrated carbonate species solidified by a hydrated species, referred to herein as the E-form hydrate or binder. Preferably, the E-form binder includes a carbonate salt, an organic phosphonate or acetate component and water. In the E-form hydrate binder, for each mole of organic phosphonate or amino acetate, there is about 3 to 10 molar parts of alkali metal carbonate monohydrate and 5 to 15 molar parts of water based on the binder weight. Typically, the E-form hydrate is dispersed throughout the solid. The solid can contain other cleaning ingredients and a controlled amount of water. The solid detergent can use a substantial proportion, sufficient to obtain non-corrosive cleaning properties, of a hydrated carbonate and a non-hydrated carbonate formed into solid.

The binder typically includes an alkali metal carbonate, an organic phosphonate sequestrant and water. A solid detergent can be manufactured including sodium carbonate, an organic phosphonate or acetate, less than about 1.3 moles of water per each mole of sodium carbonate and other optional ingredients including nonionic surfactants, defoamers, enzymes and the like. Under these conditions, a solid functional material can be manufactured from a mixture of ingredients having both hydrated sodium carbonate and non-hydrated sodium carbonate. The mixture can be formed into a solid using a hydration complex including a portion of the sodium carbonate, the organic phosphonate or acetate sequestrant and water. The majority of the water present forms carbonate monohydrate within the overall complex. The complex can be a substantially amorphous material substantially free of crystalline structure as shown in x-ray crystallographic studies. The material solidified by the complex can be in large part, about 10 to 85 wt. %, $Na_2CO_3.H_2O$ (monohydrate); less than about 25 wt. %, preferably about 0.1 to 15 wt. % anhydrous carbonate. Such solid detergent materials are preferably substantially free of a component that can compete with the alkali metal carbonate or the E-form material for water of hydration and interfere with solidification.

Enzymes

The stabilized enzyme cleaning composition of the present invention preferably includes one or more enzymes, which can provide desirable activity for removal of protein-based, carbohydrate-based, or triglyceride-based stains from substrates; for cleaning, destaining, and sanitizing presoaks, such as presoaks for medical and dental instruments, devices, and equipment; presoaks for flatware, cooking ware, and table ware; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Although not limiting to the present invention, enzymes suitable for the stabilized enzyme cleaning compositions can act by degrading or altering one or more types of soil residues encountered on an instrument or device thus removing the soil or making the soil more removable by a surfactant or other component of the cleaning composition. Both degradation and alteration of soil residues can improve detergency by reducing the physicochemical forces which bind the soil to the instrument or device being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

"Detersive enzyme", as used herein, means an enzyme having a cleaning, destaining or otherwise beneficial effect as a component of a stabilized enzyme cleaning composition for instruments, devices, or equipment, such as medical or dental instruments, devices, or equipment; or for laundry, textiles, warewashing, cleaning-in-place, drains, carpets, meat cutting tools, hard surfaces, personal care, or the like. Preferred detersive enzymes include a hydrolase such as a protease, an amylase, a lipase, or a combination thereof. Preferred enzymes in stabilized enzyme cleaning compositions for cleaning medical or dental devices or instruments include a protease, an amylase, a cellulase, a lipase, or a combination thereof. Preferred enzymes in stabilized enzyme cleaning compositions for food processing surfaces and equipment include a protease, a lipase, an amylase, a gluconase, or a combination thereof. Preferred enzymes in stabilized enzyme cleaning compositions for laundry or textiles include a protease, a cellulase, a lipase, a peroxidase, or a combination thereof. Preferred enzymes in stabilized enzyme cleaning compositions for carpets include a protease, an amylase, or a combination thereof. Preferred enzymes in stabilized enzyme cleaning compositions for meat cutting tools include a protease, a lipase, or a combination thereof. Preferred enzymes in stabilized enzyme cleaning compositions for hard surfaces include a protease, a lipase, an amylase, or a combination thereof. Preferred enzymes in stabilized enzyme cleaning compositions for drains include a protease, a lipase, an amylase, or a combination thereof.

Enzymes are normally incorporated into a stabilized enzyme cleaning composition according to the invention in an amount sufficient to yield effective cleaning during a washing or presoaking procedure. An amount effective for cleaning refers to an amount that produces a clean, sanitary, and, preferably, corrosion free appearance to the material cleaned, particularly for medical or dental devices or instruments. An amount effective for cleaning also can refer to an amount that produces a cleaning, stain removal, soil removal, whitening, deodorizing, or freshness improving effect on substrates such as medical or dental devices or instruments and the like. Such a cleaning effect can be achieved with amounts of enzyme as low as about 0.1 wt-% of the stabilized enzyme cleaning composition. In the cleaning compositions of the present invention, suitable cleaning can typically be achieved when an enzyme is present at about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%. The higher enzyme levels are typically desirable in highly concentrated cleaning or presoak formulations. A presoak is preferably formulated for use upon a dilution of about 1:500, or to a formulation concentration of about 2000 to about 4000 ppm, which puts the use concentration of the enzyme at about 20 to about 40 ppm.

Commercial enzymes, such as alkaline proteases, are obtainable in liquid or dried form, are sold as raw aqueous solutions or in assorted purified, processed and compounded forms, and include about 2% to about 80% by weight active enzyme generally in combination with stabilizers, buffers, cofactors, impurities and inert vehicles. The actual active enzyme content depends upon the method of manufacture and is not critical, assuming the stabilized enzyme cleaning composition has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions.

The stabilized enzyme cleaning compositions of the present invention preferably include at least a protease. The stabilized enzyme cleaning composition of the invention has further been found, surprisingly, to significantly stabilize protease activity in use compositions toward digesting proteins and enhancing soil removal. Further, enhanced protease activity can occur in the presence of one or more additional enzymes, such as amylase, cellulase, lipase, peroxidase, endoglucanase enzymes and mixtures thereof, preferably lipase or amylase enzymes.

A valuable reference on enzymes is "Industrial Enzymes", Scott, D., in *Kirk-Othmer Encyclopedia of Chemical Technology*, 3rd Edition, (editors Grayson, M. and EcKroth, D.) Vol. 9, pp. 173–224, John Wiley & Sons, New York, 1980.

Protease

A protease suitable for the stabilized enzyme cleaning composition of the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of Bacillus such as *Bacillus subtilis* or *Bacillus licheniformis*; these preferred proteases include native and recombinant subtilisins. The protease can be purified or a component of a microbial extract, and either wild type or variant (either chemical or recombinant). A preferred protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the stabilized enzyme cleaning composition of the invention include (with trade names) Savinase®; a protease derived from *Bacillus lentus* type, such as Maxacal®, Opticlean®, Durazym®, and Properase®; a protease derived from *Bacillus licheniformis*, such as Alcalase®, Maxatase®, Deterzyme®, or Deterzyme PAG 510/220; a protease derived from *Bacillus amyloliquefaciens*, such as Primase®; and a protease derived from *Bacillus alcalophilus*, such as Deterzyme APY. Preferred commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; those sold under the tradenames Deterzyme®, Deterzyme APY, and Deterzyme PAG 510/220 by Deerland Corporation, and the like.

A mixture of such proteases can also be used. For example, Purafect® is a preferred alkaline protease (a subtilisin) for use in detergent compositions of this invention having application in lower temperature cleaning programs, from about 30° C. to about 65° C.; whereas, Esperase® is an alkaline protease of choice for higher temperature detersive solutions, from about 50° C. to about 85° C.

Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present stabilized enzyme cleaning compositions is preferably at least 80% homologous, preferably having at least 80% sequence identity, with the amino acid sequences of the proteases in these references.

In preferred embodiments of this invention, the amount of commercial alkaline protease present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%. Typical commercially available detersive enzymes include about 5–10% of active enzyme.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the preferred solid embodiment and to use-dilution solutions. The activity of the proteases for use in the present invention are readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Chamey, J., and Harding, M. L., *J. Lab. Clin. Chem.* 34, 428 (1949).

In preferred embodiments of the present invention, the activity of proteases present in the use-solution ranges from about $1\times10^{-5}$ KNPU/gm solution to about $4\times10^{-3}$ KNPU/gm solution.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for the stabilized enzyme cleaning composition of the present invention can be derived from a plant, an animal, or a microorganism. Preferably the amylase is derived from a microorganism, such as a yeast, a mold, or a bacterium. Preferred amylases include those derived from a Bacillus, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in the stabilized enzyme cleaning composition of the invention include those sold under the trade name Rapidase by Gist-Brocades® (Netherlands); those sold under the trade names Termamyl®, Fungamyl® or Duramyl® by Novo; those sold under the trade names Purastar STL or Purastar OXAM by Genencor; those sold under the trade names Thermozyme® L340 or Deterzyme® PAG 510/220 by Deerland Corporation; and the like. Preferred commercially available amylase enzymes include the stability enhanced variant amylase sold under the trade name Duramyl® by Novo. A mixture of amylases can also be used.

Amylases suitable for the stabilized enzyme cleaning compositions of the present invention, preferably for warewashing, include: α-amylases described in WO 95/26397, PCT/DK96/00056, and GB 1,296,839 to Novo; and stability enhanced amylases described in J. Biol. Chem., 260(11):6518–6521 (1985); WO 9510603 A, WO 9509909 A and WO 9402597 to Novo; references disclosed in WO 9402597; and WO 9418314 to Genencor International. A variant α-amylase employed in the present stabilized enzyme cleaning compositions is preferably at least 80% homologous, preferably having at least 80% sequence identity, with the amino acid sequences of the proteins of these references.

Preferred amylases for use in the stabilized enzyme cleaning compositions of the present invention have enhanced stability compared to certain amylases, such as Termamyl®. Enhanced stability refers to a significant or measurable improvement in one or more of: oxidative stability, e.g., to hydrogen peroxide/tetraacetylethylenediamine in buffered solution at pH 9–10; thermal stability, e.g., at common wash temperatures such as about 60° C.; and/or alkaline stability, e.g., at a pH from about 8 to about 11; each compared to a suitable control amylase, such as Termamyl®. Stability can be measured by methods known to those of skill in the art. Preferred enhanced stability amylases for use in the stabilized enzyme cleaning compositions of the present invention have a specific activity at least 25% higher than the specific activity of Termamyl® at a temperature in a range of 25° C. to 55° C. and at a pH in a range of about 8 to about 10. Amylase activity for such comparisons can be measured by assays known to those of skill in the art and/or commercially available, such as the Phadebas® α-amylase assay.

In preferred embodiments of this invention, the amount of commercial amylase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 0.25–5% of active amylase.

Whereas establishing the percentage by weight of amylase required is of practical convenience for manufacturing embodiments of the present teaching, variance in commercial amylase concentrates and in-situ environmental additive and negative effects upon amylase activity may require a more discerning analytical technique for amylase assay to quantify enzyme activity and establish correlations to soil residue removal performance and to enzyme stability within the preferred embodiment and to use-dilution solutions. The activity of the amylases for use in the present invention can be expressed in units known to those of skill or through amylase assays known to those of skill in the art and/or commercially available, such as the Phadebas® α-amylase assay.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

A cellulase suitable for the stabilized enzyme cleaning composition of the present invention can be derived from a plant, an animal, or a microorganism. Preferably the cellulase is derived from a microorganism, such as a fungus or a bacterium. Preferred cellulases include those derived from a fungus, such as *Humicola insolens*, Humicola strain DSM 1800, or a cellulase 212-producing fungus belonging to the genus Aeromonas and those extracted from the hepatopancreas of a marine mollusk, *Dolabella auricula* Solander. The cellulase can be purified or a component of an extract, and either wild type or variant (either chemical or recombinant).

Examples of cellulase enzymes that can be employed in the stabilized enzyme cleaning composition of the invention include those sold under the trade names Carezyme® or Celluzyme® by Novo; under the tradename Cellulase by Genencor; under the tradename Deerland Cellulase 4000 or Deerland Cellulase TR by Deerland Corporation; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

In preferred embodiments of this invention, the amount of commercial cellulase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 5–10 percent of active enzyme.

Whereas establishing the percentage by weight of cellulase required is of practical convenience for manufacturing embodiments of the present teaching, variance in commercial cellulase concentrates and in-situ environmental additive and negative effects upon cellulase activity may require a more discerning analytical technique for cellulase assay to quantify enzyme activity and establish correlations to soil residue removal performance and to enzyme stability within the preferred embodiment and to use-dilution solutions. The activity of the cellulases for use in the present invention can be expressed in units known to those of skill or through cellulase assays known to those of skill in the art and/or commercially available.

Naturally, mixtures of different cellulase enzymes can be incorporated into this invention. While various specific enzymes have been described above, it is to be understood that any cellulase which can confer the desired cellulase activity to the composition can be used and this embodiment of this invention is not limited in any way by specific choice of cellulase enzyme.

Lipases

A lipase suitable for the stabilized enzyme cleaning composition of the present invention can be derived from a plant, an animal, or a microorganism. Preferably the lipase is derived from a microorganism, such as a fungus or a bacterium. Preferred lipases include those derived from a Pseudomonas, such as *Pseudomonas stutzeri* ATCC 19.154, or from a Humicola, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the stabilized enzyme cleaning composition of the invention include those sold under the trade names Lipase P "Amano" or "Amano-P" by Amano Pharmaceutical Co. Ltd., Nagoya, Japan or under the trade name Lipolase® by Novo, and the like. Other commercially available lipases that can be employed in the present compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*. A preferred lipase is sold under the trade name Lipolase® by Novo.

Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

In preferred embodiments of this invention, the amount of commercial lipase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 5–10 percent of active enzyme.

Whereas establishing the percentage by weight of lipase required is of practical convenience for manufacturing embodiments of the present teaching, variance in commercial lipase concentrates and in-situ environmental additive and negative effects upon lipase activity may require a more discerning analytical technique for lipase assay to quantify enzyme activity and establish correlations to soil residue removal performance and to enzyme stability within the preferred embodiment and to use-dilution solutions. The activity of the lipases for use in the present invention can be expressed in units known to those of skill or through lipase assays known to those of skill in the art and/or commercially available.

Naturally, mixtures of different lipase enzymes can be incorporated into this invention. While various specific enzymes have been described above, it is to be understood that any lipase which can confer the desired lipase activity to the composition can be used and this embodiment of this invention is not limited in any way by specific choice of lipase enzyme.

Additional Enzymes

Additional enzymes suitable for use in the present stabilized enzyme cleaning compositions include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Peroxidases suitable for stabilized enzyme cleaning compositions are disclosed in WO 89099813 A and WO 8909813 A to Novo. Peroxidase enzymes can be used in combination with oxygen sources, e.g., percarbonate, percarbonate, hydrogen peroxide, and the like. Additional enzymes suitable for incorporation into the present stabilized enzyme cleaning composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the stabilized enzyme cleaning composition of the present invention can be derived from a plant, an animal, or a microorganism. Preferably the enzyme is derived from a microorganism. The enzyme can be purified or a component of an extract, and either wild type or variant (either chemical or recombinant). In preferred embodiments of this invention, the amount of commercial additional enzyme, such as a cutinase or peroxidase, present in the composition of the invention ranges from about 1 to about 30 wt-%, preferably about 2 to about 15 wt-%, preferably about 3 to about 10 wt-%, preferably about 4 to about 8 wt-%, of the commercial enzyme product. Typical commercially available detersive enzymes include about 5–10 percent of active enzyme.

Whereas establishing the percentage by weight of additional enzyme, such as a cutinase or peroxidase, required is of practical convenience for manufacturing embodiments of the present teaching, variance in commercial additional enzyme concentrates and in-situ environmental additive and negative effects upon their activity may require a more discerning analytical technique for the enzyme assay to quantify enzyme activity and establish correlations to soil residue removal performance and to enzyme stability within the preferred embodiment and to use-dilution solutions. The activity of the additional enzyme, such as a cutinase or peroxidase, for use in the present invention can be expressed in units known to those of skill or through assays known to those of skill in the art and/or commercially available.

Naturally, mixtures of different additional enzymes can be incorporated into this invention. While various specific enzymes have been described above, it is to be understood that any additional enzyme which can confer the desired enzyme activity to the composition can be used and this embodiment of this invention is not limited in any way by specific choice of enzyme.

Enzyme Stabilizing System

The enzyme stabilizing system of the present invention includes a mixture of carbonate and bicarbonate. The enzyme stabilizing system can also include other ingredients to stabilize certain enzymes or to enhance or maintain the effect of the mixture of carbonate and bicarbonate.

Stabilizing systems of certain cleaning compositions, for example medical or dental instrument or device stabilized enzyme cleaning compositions, may further include from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic. Since percarbonate or percarbonate, which have the ability to react with chlorine bleach, may be present in certain of the instant compositions in amounts accounted for separately from the stabilizing system, the use of additional stabilizers against chlorine, may, most generally, not be essential, though improved results may be obtainable from their use.

Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium percarbonate tetrahydrate, sodium percarbonate monohydrate and sodium percarbonate, as well as phosphate, condensed phosphate, acetate, benzoate, citrate, formate, lactate, malate, tartrate, salicylate, etc., and mixtures thereof can be used if desired.

In general, since the chlorine scavenger function can be performed by ingredients separately listed under better recognized functions, there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is unacceptably incompatible, as formulated, with other reactive ingredients. In relation to the use of ammonium salts, such salts can be simply admixed with the stabilized enzyme cleaning composition but are prone to adsorb water and/or liberate ammonia during storage. Accordingly, such materials, if present, are desirably protected in a particle such as that described in U.S. Pat. No. 4,652,392, Baginski et al.

Additional Ingredients

The present stabilized enzyme cleaning composition can include any of a variety of ingredients typically included in enzyme or other cleaning compositions. Such ingredients include, but are not limited to, a surfactant, a metal protecting silicate, a chelating or sequestering agent, a builder, secondary hardening agent or solubility modifier, detergent filler, defoamer, anti-redeposition agent, a threshold agent or system, polyol, wetting agent, hydrotrope, as well as pigments or dye, fragrance, carbohydrate, and the like. Adjuvants and other additive ingredients will vary according to the type of composition being manufactured.

Such additional ingredients can be preformulated with the stabilized enzyme composition of the invention or added to the system simultaneously, or even after, the addition of the enzyme composition. The composition of the invention can also contain any number of other constituents as necessitated by the application, which are known to those of skill in the art and which can facilitate the activity of the present invention.

Chelating Agents or Sequestrants

Chelating agents or sequestrants generally useful in the present compositions include alkyl diamine polyacetic acid-type chelating agents such as EDTA (ethylene diamine tetraacetate tetrasodium salt), acrylic and polyacrylic acid-type stabilizing agents, phosphonic acid, and phosphonate-type chelating agents among others. Preferable sequestrants include phosphonic acids and phosphonate salts including 1-hydroxyethylidene-1,1-diphosphonic acid ($CH_3C(PO_3H_2)_2OH$) (HEDP), amino[tri(methylene phosphonic acid)] (ATMP), ethylene diamine[tetra methylene-phosphonic acid)], 2-phosphene butane-1,2,4-tricarboxylic acid (PBTC), as well as the alkyl metal salts, ammonium salts, or alkyloyl amine salts, such as mono, di, or tetra-ethanolamine salts.

Amino phosphates and phosphonates are also suitable for use as chelating agents in the compositions of the invention and include ethylene diamine (tetramethylene phosphonates), nitrilotrismethylene phosphates, diethylenetriamine (pentamethylene phosphonates). These amino phosphonates commonly contain alkyl or alkaline groups with less than 8 carbon atoms. The phosphonic acid may also include a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

Commercially available chelating agents include phosphonates sold under the trade name DEQUEST® including, for example, 1-hydroxyethylidene-1,1-diphosphonic acid, available from Monsanto Industrial Chemicals Co., St. Louis, Mo., as DEQUEST® 2010; amino(tri(methylenephosphonic acid)), ($N[CH_2PO_3H_2]_3$), available from Monsanto as DEQUEST® 2000; ethylenediamine [tetra(methylenephosphonic acid)] available from Monsanto as DEQUEST® 2041; and 2-phosphonobutane-1,2,4-tricarboxylic acid available from Mobay Chemical Corporation, Inorganic Chemicals Division, Pittsburgh, Pa., as Bayhibit AM; and amino[tri(methylene phosphonic acid)] (ATMP) available as Briquest 301-50A: Amino Tri (Methylene Phosphonic Acid) (ATMP), 50%, low ammonia from Albright & Wilson.

The above-mentioned phosphonic acids can also be used in the form of water soluble acid salts, particularly the alkali metal salts, such as sodium or potassium; the ammonium salts or the alkylol amine salts where the alkylol has 2 to 3 carbon atoms, such as mono-, di-, or triethanolamine salts. If desired, mixtures of the individual phosphonic acids or their acid salts can also be used.

Builder

Detergent builders can optionally be included in the stabilized enzyme cleaning compositions of the present invention for purposes including assisting in controlling mineral hardness. Inorganic as well as organic builders can be used. The level of builder can vary widely depending upon the end use of the composition and its desired physical form.

Inorganic or phosphate-containing detergent builders include alkali metal, ammonium and alkanolammonium salts of polyphosphates (e.g. tripolyphosphates, pyrophosphates, and glassy polymeric meta-phosphates). Non-phosphate builders may also be used. These can include phytic acid, silicates, alkali metal carbonates (e.g. carbonates, bicarbonates, and sesquicarbonates), sulphates, aluminosilicates, monomeric polycarboxylates, homo or copolymeric polycarboxylic acids or their salts in which the polycarboxylic acid includes at least two carboxylic radicals separated from each other by not more than two carbon atoms, citrates, succinates, and the like. Preferred builders include citrate builders, e.g., citric acid and soluble salts thereof, due to their ability to enhance detergency of a soap or detergent solution and their availability from renewable resources and their biodegradability.

Surfactant

The surfactant or surfactant admixture of the present invention can be selected from water soluble or water dispersible nonionic, semi-polar nonionic, anionic, cationic, amphoteric, zwitterionic surface-active agents, or any combination thereof. The particular surfactant or surfactant mixture chosen for use in the process and products of this invention can depend on the conditions of final utility, including method of manufacture, physical product form, use pH, use temperature, foam control, and soil type. Surfactants incorporated into the stabilized enzyme cleaning compositions of the present invention are preferably enzyme compatible, not substrates for the enzyme, and not inhibitors or inactivators of the enzyme. For example, when proteases and amylases are employed in the present compositions, the surfactant is preferably free of peptide and glycosidic bonds. In addition, certain cationic surfactants are known in the art to decrease enzyme effectiveness. A typical listing of the classes and species of surfactants useful herein appears in U.S. Pat. No. 3,664,961 issued May 23, 1972, to Norris.

Preferred surfactants include nonionic surfactants, such as alkylphenol alkoxylates. Alkylphenol alkoxylates include condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. Preferred alkyl phenol alkoxylates include having a $C_{1-12}$ alkyl group and from about 3 to 16 moles of alkylene oxide, such as nonylphenol ethoxylates, such as nonylphenol ethoxylate 9.5.

Surfactants can be used singly or in combination in the practice and utility of the present invention. In particular, nonionics and anionics can be used in combination. Semi-polar nonionic, cationic, amphoteric and zwitterionic surfactants can be employed in combination with nonionics or anionics. The organic surfactant compounds can be formulated into any of the several commercially desirable composition forms of this invention having disclosed utility. Said compositions are washing or presoak treatments for soiled surfaces in concentrated form which, when dispensed or dissolved in water, properly diluted by a proportionating device, and delivered to the target surfaces as a solution, gel or foam will provide cleaning.

Metal Protecting Silicates

We have found that an effective amount of an alkaline metal silicate or hydrate thereof can be employed in the compositions and processes of the invention to form a stable solid cleaning composition that can have metal protecting capacity. The silicates employed in the compositions of the invention are known in the art. For example, typical alkali metal silicates are those powdered, particulate or granular silicates which are either anhydrous or preferably which contain water of hydration (5 to 25 wt %, preferably 15 to 20 wt % water of hydration). These silicates are preferably sodium silicates and have a $Na_2O:SiO_2$ ratio of about 1:1 to about 1:5, respectively, and typically contain available bound water in the amount of from 5 to about 25 wt %. In general, the silicates employed in the present compositions have a $Na_2O:SiO_2$ ratio of 1:1 to about 1:3.75, preferably about 1:1.5 to about 1:3.75 and most preferably about 1:1.5 to about 1:2.5. A silicate with a $Na_2O:SiO_2$ ratio of about 1:2 and about 16 to 22 wt % water of hydration, is most preferred. For example, such silicates are available in powder form as GD Silicate and in granular form as Britesil H-20, from PQ Corporation. These ratios may be obtained with single silicate compositions or combinations of silicates which upon combination result in the preferred ratio. The hydrated silicates at preferred ratios, a $Na_2O:SiO_2$ ratio of about 1:1.5 to about 1:2.5 have been found to provide the optimum metal protection and rapidly forming solid block detergent. The amount of silicate used in forming the compositions of the invention tend to vary between 10 and 30 wt %, preferably about 15 to 30 wt % depending on degree of hydration. Hydrated silicates are preferred.

Sanitizers

Sanitizing agents also known as antimicrobial agents are chemical compositions that can be used in a solid enzyme cleaning composition to prevent microbial contamination of instruments, such as medical and dental devices or instruments. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria, fungi, viruses, and the like. In use, the antimicrobial agents are formed into a enzyme cleaning composition that when diluted and dispensed using an aqueous stream forms an aqueous disinfectant or sanitizer composition that can be contacted with a variety of surfaces resulting in prevention of growth or the killing of a substantial proportion of the microbial population. Common antimicrobial agents include phenolic antimicrobials such as pentachlorophenol, orthophenylphenol. Halogen containing antibacterial agents include sodium trichloroisocyanurate, iodine-poly(vinylpyrolidinonen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties.

Defoaming Agents

A minor but effective amount of a defoaming agent for reducing the stability of foam may also be included in the present cleaning compositions. Preferably, the cleaning composition includes about 0.0001–5 wt % of a defoaming agent, preferably about 0.01–3 wt %.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Dyes and Fragrances

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine orjasmal, vanillin, and the like.

Concentrate and Use Compositions

The present solid enzyme cleaning compositions can be dissolved in a carrier, typically water, to form concentrate and use compositions. The solid can be dissolved in water to form a concentrate composition, which can then be further diluted to a use composition. The solid can yield concentrate compositions that include up to about 2 to about 4 wt-% of the solid enzyme cleaning composition with the remainder typically being carrier. Concentrate compositions can have concentrations of solid enzyme cleaning composition as low as about 0.3 wt-%. The solid enzyme cleaning composition can also be dissolved at lower concentrations, for example as low as 0.03 wt-%, to form concentrate or use compositions. Use compositions can be obtained directly by dissolving the solid composition in about 500 parts of water or at a concentration of about 300 to about 8000 ppm. Preferred use compositions include about 0.03 to about 1 wt-% solid enzyme cleaning composition.

Methods Employing the Present Compositions

The compositions of the present invention can be employed in a variety of methods for cleaning, washing, or presoaking medical or dental devices, instruments, or equipment. Methods that can employ the compositions of the invention include processing the device, instrument, or equipment by presoaking, spraying, ultrasonic treatment, or mechanized washing. Such methods include presoaking in tray, tub, pan, or sink; spraying through an instruments washer; use in ultrasonic machines, use in a cart or cage washer; and use in a laboratory glass machine washer, especially one with a presoak step.

Manual Presoak Method

According to the manual presoaking method aspect of this invention, soiled medical or dental instruments, medical devices, or portions of medical devices are contacted with an effective amount, typically from about 0.03% to about 0.8% by weight, preferably from about 0.2% to about 0.4% by weight, of the composition of the present invention. Such an effective amount can be used to presoak, for example, about 300 instruments in about 3 to about 5 gallons of the diluted composition. The actual amount of presoak composition used will be based on the judgment of user, and will depend upon factors such as the particular product formulation of the composition, the concentration of the composition, the number of soiled articles to be presoaked and the degree of soiling of the articles. Subsequently, the items are subjected to a manual or machine washing or rinsing method, involving either further washing steps and use of detergent product, and/or to a manual or machine rinsing method.

Machine Wash or Presoak Method

The compositions of the present invention can be employed in a variety of machines that wash or soak instruments, such as medical or dental instruments or devices. Such machines can be charged manually with powder or other solid forms of the composition. Such machines can also automatically dispense the present compositions. Such dispensing can include dissolving the solid composition to form a liquid concentrate composition, optionally diluting the first liquid concentrate composition to yield a second liquid concentrate composition (that is less concentrated), and diluting the liquid concentrate into the wash or soak chamber to form the use composition. The use composition can be used to wash or soak the instruments.

The present invention may be better understood with reference to the following examples. These examples are intended to be representative of specific embodiments of the invention, and are not intended as limiting the scope of the invention.

EXAMPLES

Example 1

Cleaning Compositions With Mixtures of Carbonate and Bicarbonate That Stabilize Enzymes

TABLE 1

Test formulas with various ratios of carbonate to bicarbonate, all percentages are weight percentages.

| Ingredient | Control | Formula 2 | Formula 4 | Formula 7 | Formula 9 | Formula R |
|---|---|---|---|---|---|---|
| Dense Ash ($Na_2CO_3$) | 47.6% | 32.6% | 47.6% | 28.8% | 38.8% | 38.8% |
| Nonionic Surfactant | 7.5% | 7.5% | 7.5% | 7.5% | 7.5% | 7.5% |
| Tripoly ($Na_5P_3O_{10}$) | 30% | 30% | 20% | 20% | 20% | 20% |
| Sodium Bicarbonate ($NaHCO_3$) | 0 | 15% | 10% | 28.8% | 18.8% | 18.8% |

TABLE 1-continued

Test formulas with various ratios of carbonate to bicarbonate, all percentages are weight percentages.

| Ingredient | Control | Formula 2 | Formula 4 | Formula 7 | Formula 9 | Formula R |
|---|---|---|---|---|---|---|
| Protease | 1% | 1% | 1% | 1% | 1% | 1% |
| Phosphonate | 5.8% | 5.8% | 5.8% | 5.8% | 5.8% | 6.6% |
| NaOH, 50% | 2.3% | 2.3% | 2.3% | 2.3% | 2.3% | 2.6% |
| Soft Water | 5.8% | 5.8% | 5.8% | 5.8% | 5.8% | 4.7% |
| | 100% | 100% | 100% | 100% | 100% | 100% |
| Ratio of Carbonate: Bicarbonate | | 2.2:1 | 4.8:1 | 1:1 | 2.1:1 | 2.1:1 |

The protease employed was from Genencor and designated 4000S. Formula R also includes 0.1 wt-% direct blue 86.

TABLE 2

Formulas of cleaning compositions with mixtures of carbonate and bicarbonate with varying amounts of enzyme, all percentages are weight percentages.

| Ingredient | Low Enzyme Formula | Mid-Enzyme Formula | High Enzyme Formula |
|---|---|---|---|
| Dense Ash ($Na_2CO_3$) | 41.6% | 40.8% | 40% |
| Nonionic Surfactant | 8.7% | 8.6% | 8.3% |
| Tripoly ($Na_5P_3O_{10}$) | 18.1% | 17.8% | 17.4% |
| Sodium Bicarb ($NaHCO_3$) | 15.3% | 15% | 14.7% |
| Protease | 3.9% | 5.9% | 7.7% |
| Phosphonate | 4.8% | 4.7% | 4.6% |
| NaOH, 50% | 3.4% | 3.3% | 3.2% |
| Dye | 0.01% | 0.01% | 0.01% |
| Fragrance | 0.8% | 0.8% | 0.7% |
| Soft Water | 3.4% | 3.3% | 3.2% |
| | 100.00% | 100.00% | 100.00% |
| Ratio of Carbonate:Bicarbonate | 2.7:1 | 2.7:1 | 2.7:1 |

Example 2

Effective Cleaning by Compositions Containing Mixtures of Carbonate and Bicarbonate Formulas of Table 1 were evaluated and demonstrated to clean effectively.

Materials and Methods

Commercially available stainless steel knives were coated with a protein film and then soaked in use compositions of the formulas described in Table 1. The knives were coated with a film of egg yoke that has been dyed blue with Coomassie blue by dipping the knives into a solution containing the protein marker. The formulas of Table 1 were diluted to a concentration of 0.25 wt-% and kept at room temperature or heated to 120° F. The protein-coated knives were soaked in the diluted cleaning compositions for 15 or 30 minutes.

After soaking, the knives were rinsed and rated for cleanliness. A rating of 1 indicates the knife is dirty, and appeared mostly blue. A rating of 2 indicates that the knife is semi-clean, and appeared mostly yellow or orange. A rating of 3 indicated small residual protein film, and the knife appeared faint yellow or orange. A rating of 4 indicated that the knife was clean, and that there was no colored film remaining on the knife.

Results

The results of this study are reported in Table 3. At room temperature, each of the formulas resulted in residual protein film (2 rating) at 15 minutes and a clean knife (4 rating) at 30 minutes. At 120° F., the control formula produced only a semi-clean knife (3 rating). At this higher temperature, formulas 2, 7, and 9 produced a clean knife (4 rating) after only 15 minutes. The knife soaked in formula 4 was only semi-clean (3 rating) at both time points at 120° F.

TABLE 3

Cleaning of protein films from knives by Control Formula and Formulas 2, 4, 7, and 9.

| Formula | Time (min) | Room Temp. | 120° F. |
|---|---|---|---|
| Control | 15 | Residual | Semi |
| | 30 | Clean | Semi |
| 2 | 15 | Residual | Clean |
| | 30 | Clean | Clean |
| 4 | 15 | Residual | Semi |
| | 30 | Clean | Semi |
| 7 | 15 | Residual | Clean |
| | 30 | Clean | Clean |
| 9 | 15 | Residual | Clean |
| | 30 | Clean | Clean |

Conclusions

Each of the formulas effectively removed protein film from a knife after 30 minutes of soaking at room temperature. The formulas 2, 7, and 9, which include a mixture of carbonate and bicarbonate, cleaned more effectively than the control formula at 120 ° F. Formula R was also an effective cleaner.

Example 3

Effective Enzyme Stabilization by Compositions Containing Mixtures of Carbonate and Bicarbonate Formulas of Table 1 were evaluated and demonstrated to effectively stabilize an enzyme.

Materials and Methods

Use compositions of the control formula and formulas 2, 7, and 9 were preincubated at room temperature or at 120 ° F. for 15 and 30 minutes. The protease activity in a diluted sample of a preincubation mixture was assayed employing azocasein as a substrate and 0.2 M tris buffer at pH 8.5 and 40° C. The reaction was run for 30 minutes and quenched with 5% trichloroacetic acid. Absorbance was read at 390 nm.

Results

The results of the protease assays are reported in Table 4. The enzyme remained stable for at least 30 minutes at room temperature in each of the control formula and formulas 2, 7, and 9. The enzyme was not stable for even 15 minutes at 120° F. in the control formula or in formula 2. At 120° F., formulas 7 and 9 retained about half of the enzyme activity after a 30 minute preincubation.

TABLE 4

Enzyme activity remaining after preincubation of use compositions including mixtures of carbonate and bicarbonate at room temperature or 120° F.

| Formula | Preincubation Time (min) | Preincubation at Room Temp. Enzyme Activity Remaining | Preincubation at 120° F. Enzyme Activity Remaining |
|---|---|---|---|
| Control | 15 | 95% | 12% |
| | 30 | 98% | none |
| 2 | 15 | 99% | 2% |
| | 30 | 103% | none |
| 7 | 15 | 96% | 62% |
| | 30 | 98% | 54% |
| 9 | 15 | 101% | 58% |
| | 30 | 96% | 41% |

Conclusions

Each of the formulas adequately stabilized the enzyme at room temperature. Only formulas 7 and 9 effectively stabilized the enzyme at 120° F. Formula R also effectively stabilized the enzyme.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

We claim:

1. A method of cleaning a medical or dental instrument, comprising:

dissolving a solid enzyme cleaning composition in water, the solid enzyme cleaning composition comprising detersive enzyme and a mixture of carbonate and bicarbonate; the carbonate and bicarbonate being present in a weight ratio of about 0.5:1 to about 4.75:1;

contacting the medical or dental instrument with the dissolved solid enzyme cleaning composition at a temperature at or above ambient temperature wherein said;

the medical or dental instrument comprising forceps, scissor, shear, saw, hemostat, knife, chisel, rongeur, file, nipper, drill, drill bit, rasp, burr, spreader, breaker, clamp, needle holder, carrier, clip, hook, gouge, curette, retractor, straightener, punch, extractor, scoop, keratome, expressor, trocar, dilator, cage, catheter, cannula, plug, stent, arthoscope, or combinations thereof.

2. The method of claim 1, wherein the weight ratio of carbonate to bicarbonate is in the range of about 2:1 to about 3:1.

3. The method of claim 2, wherein the composition comprises about 30 to about 50 weight percent carbonate and about 10 to about 30 weight percent bicarbonate.

4. The method of claim 1, wherein the composition further comprises an E-form hydrate.

5. The method of claim 1, wherein the detersive enzyme retains at least about 50% of its initial activity at 120° F. for at least about 30 minutes after dissolving the composition.

6. The method of claim 1, wherein the detersive enzyme comprises protease, amylase, lipase, cellulase, peroxidase, gluconase, or a combination thereof.

7. The method of claim 1, wherein the composition further comprises nonionic surfactant, builder, and chelating agent.

8. The method of claim 7, wherein the nonionic surfactant comprises nonyl phenol ethoxylate, the builder comprises tripolyphosphate, and the chelating agent comprises amino tri(methylene phosphonic acid) (ATMP).

9. The method of claim 1, wherein the solid enzyme cleaning composition is in the form of pellet, tablet, lozenge, puck, briquette, brick, solid block, or unit dose.

10. The method of claim 1, wherein the solid enzyme cleaning composition comprises plurality of detersive enzymes.

11. The method of claim 1, wherein the solid enzyme cleaning composition comprises metal protecting silicate.

12. A solid enzyme cleaning composition:

the composition being in the form of pellet, tablet, lozenge, puck, briquette, brick, solid block, or unit dose;

the composition comprising:

detersive enzyme and a mixture of carbonate and bicarbonate;

the carbonate and bicarbonate being present in a weight ratio of about 3.5:1 to about 4.75:1;

wherein the ratio of carbonate to bicarbonate is selected to increase stability of the detersive enzyme in the solid composition at ambient temperature.

13. The composition of claim 12, comprising about 30 to about 50 weight percent carbonate and about 10 to about 30 weight percent bicarbonate.

14. The composition of claim 12, wherein the detersive enzyme retains at least about 50% of its initial activity at 120° F. for at least about 30 minutes after forming a use composition.

15. The composition of claim 12, further comprising an E-form hydrate.

16. The composition of claim 12, wherein the detersive enzyme comprises protease, amylase, lipase, cellulase, peroxidase, gluconase, or a combination thereof.

17. The composition of claim 16, wherein the detersive enzyme comprises alkaline protease, lipase, amylase, or a combination thereof.

18. The composition of claim 12, further comprising nonionic surfactant, builder, and chelating agent.

19. The composition of claim 18, wherein the nonionic surfactant comprises nonyl phenol ethoxylate, the builder comprises tripolyphosphate, and the chelating agent comprises amino tri(methylene phosphonic acid) (ATMP).

20. The composition of claim 19, comprising about 8 wt-% nonyl phenol ethoxylate, about 18 wt-% tripolyphosphate, about 4 wt-% protease, and about 5 wt-% ATMP.

21. The composition of claim 19, comprising about 8 wt-% nonyl phenol ethoxylate 9.5, about 17 wt-% tripolyphosphate, about 8 wt-% protease, and about 5 wt-% ATMP.

22. The composition of claim 19, comprising about 7.5 wt-% nonyl phenol ethoxylate 9.5, about 20 wt-% tripolyphosphate, about 1 wt-% protease, and about 7 wt-% ATMP.

23. A liquid concentrate composition comprising:

about 0.3 to about 4 wt-% water, detersive enzyme, and a mixture of carbonate and bicarbonate;

the carbonate and bicarbonate being present in a weight ratio of about 3.5:1 to about 4.75:1.

24. A solid enzyme cleaning composition comprising:

plurality of detersive enzymes, the plurality of detersive enzymes comprising:

protease plus;

amylase, lipase, cellulase, peroxidase, gluconase, or a combination thereof; and a mixture of carbonate and bicarbonate;

the carbonate and bicarbonate being present in a weight ratio of about 3.5:1 to about 4.75:1;

wherein the ratio of carbonate to bicarbonate is selected to increase stability of the plurality of detersive enzymes.

25. The composition of claim 24, wherein the mixture of carbonate and bicarbonate stabilizes the plurality of enzymes in use compositions at use temperatures.

26. The composition of claim 24, wherein the plurality of detersive enzymes comprises:

alkaline protease plus lipase, amylase, or a combination thereof.

27. The method of claim 1, wherein the saw comprises a bone saw.

28. The method of claim 1, wherein:

contacting the medical or dental instrument with the dissolved solid enzyme cleaning composition at a temperature at or above ambient temperature comprises:

presoaking the medical or dental instrument in the dissolved solid enzyme cleaning composition at a temperature at or above ambient temperature.

29. The method of claim 1, wherein:

contacting the medical or dental instrument with the dissolved solid enzyme cleaning composition at a temperature at or above ambient temperature comprises:

spraying the medical or dental instrument with the dissolved solid enzyme cleaning composition at a temperature at or above ambient temperature.

30. The method of claim 1, wherein:

contacting the medical or dental instrument with the dissolved solid enzyme cleaning composition at a temperature at or above ambient temperature comprises:

machine washing the medical or dental instrument with the dissolved solid enzyme cleaning composition at a temperature at or above ambient temperature.

31. The method of claim 1, wherein:

contacting the medical or dental instrument with the dissolved solid enzyme cleaning composition at a temperature at or above ambient temperature comprises:

ultrasonic treatment of the medical or dental instrument in the dissolved solid enzyme cleaning composition at a temperature at or above ambient temperature.

* * * * *